United States Patent [19]

Hoyt et al.

[11] Patent Number: 4,972,775

[45] Date of Patent: Nov. 27, 1990

[54] ELECTROSTATIC PASSIVE PROXIMITY FUZING SYSTEM

[75] Inventors: David G. Hoyt, Waterbury Ctr.; Richard T. Ziemba, Burlington, both of Vt.

[73] Assignee: General Electric Company, Burlington, Vt.

[21] Appl. No.: 452,151

[22] Filed: Dec. 18, 1989

[51] Int. Cl.[5] ..... F42C 13/00

[52] U.S. Cl. ..... 102/211; 102/215

[58] Field of Search ..... 102/211, 215

[56] References Cited

U.S. PATENT DOCUMENTS

| | | | |
|---|---|---|---|
| 3,527,167 | 9/1970 | Morse | 102/9 |
| 3,648,287 | 3/1972 | Lind | 343/18 E |
| 3,938,147 | 2/1976 | Kalmus | 343/7 PF |
| 3,949,955 | 4/1976 | Sykes et al. | 244/3.19 |
| 4,032,918 | 6/1977 | Masin | 343/7 PF |
| 4,183,303 | 1/1980 | Krupen | 102/211 |
| 4,185,559 | 1/1980 | Little | 102/211 |
| 4,193,072 | 3/1980 | McKusick | 343/6 ND |
| 4,240,350 | 12/1980 | Munzel et al. | 102/215 |
| 4,291,627 | 9/1981 | Ziemba et al. | 102/265 |
| 4,372,192 | 2/1983 | Lienau | 89/1.8 |
| 4,625,647 | 12/1986 | Laures | 102/214 |
| 4,875,075 | 1/1990 | Munzel | 102/214 |

*Primary Examiner*—Charles T. Jordan
*Assistant Examiner*—Rochelle Lieberman
*Attorney, Agent, or Firm*—Bailin L. Kuch; Robert A. Cahill

[57] ABSTRACT

A proximity fuzing system for missile warhead utilizes an electrostatic probe to detect the electric field inherently associated with an airborne target. The probe plates are oriented perpendicular to the missile longitudinal axis and are short circuit loaded to develop a probe current signal whose initial slope is analyzed to qualify the target being engaged on a near-miss trajectory as a valid target and whose first zero current crossing is utilized as a trigger point for detonating the missile warhead before the missiles reaches a position of minimum miss-distance relative to the target.

8 Claims, 3 Drawing Sheets

ELECTROSTATIC PASSIVE PROXIMITY FUZING SYSTEM

BACKGROUND OF THE INVENTION

Current missile fuzing systems typically utilize RF (radar) or optical (infrared) sensors to detect missile proximity to an airborne target and to detonate the missile warhead at the opportune moment in the missile trajectory to maximize the damage inflicted on the target. Unfortunately, these active proximity fuzing systems are susceptible to countermeasures effected by the target. RF sensors can be jammed electronically, and optical sensors can be confused by flares. The results are either no warhead detonation or detonation outside the target kill range.

It would of course be desirable that a proximity fuzing system not be susceptible to target countermeasures. To this end, serious consideration is being given to utilizing electrostatic sensors in proximity fuzing systems, see, for example, Ziemba et al. U.S. Pat. No. 4,291,627, issued Sept. 29, 1981. As is well known, the outer surface of any airborne target becomes electrostatically charged while in flight through the atmosphere due to the effects of air friction and engine ionization generation. Thus, detection of the electrostatic field closely surrounding an airborne target can provide the means for detecting the proximity of an attacking missile to the target. By appropriate processing of electrostatic sensor signals, the warhead can be detonated at a point in the missile trajectory proximate the target to maximize the possibility of target kill, see, for example, Krupen U.S. Pat. No. 4,183,303, issued Jan. 15, 1980. Since this inherent electrostatic field can not be readily recreated in disassociated relation to the target, engaging missiles equipped with electrostatic fuzing system sensors are not susceptible to being "spoofed" by any countermeasures a target can employ.

SUMMARY OF THE INVENTION

It is accordingly an object of the present invention to provide an improved proximity fuzing system for missiles engaging airborne targets.

A further object is to provide an attacking missile fuzing system of the above-character, which is essentially immune to target countermeasures.

An additional object is to provide a proximity fuzing system of the above-character, wherein the potential for target kill by an attacking missile is maximized.

Other objects of the invention will in part be obvious and in part appear hereinafter.

Pursuant to the foregoing objectives, the present invention provides a passive proximity fuzing system for an attack missile, which utilizes an electrostatic probe to detect missile entry into the electric field inherently associated with an airborne target. The electrostatic probe is in the form of a pair of parallel spaced, conductive plates oriented perpendicular to the missile longitudinal axis, i.e., perpendicular to the missile trajectory path. The short circuit current signal response of the probe to entry into the target electric field is amplified and processed in accordance with a target algorithm to determine that the increasing initial slope of the probe signal waveform is within an established range of slope values characteristic of a valid target. If this criteria is satisfied, the missile warhead is detonated on the first zero crossing of the probe signal waveform, which corresponds to the most opportune point on a missile near-miss trajectory to inflict maximum damage on the target.

The invention according comprises the features of construction, combination of elements and arrangement of parts, all of which will be detailed below, and the scope of the invention will be indicated in the claims.

BRIEF DESCRIPTION OF THE DRAWINGS

For a full understanding of the nature and objects of the present invention, reference may be had to the following Detailed Description taken in conjunction with the accompanying drawings, in which.

Corresponding reference numerals refer to like parts throughout the several views of the drawings.

DETAILED DESCRIPTION

Figure 1:
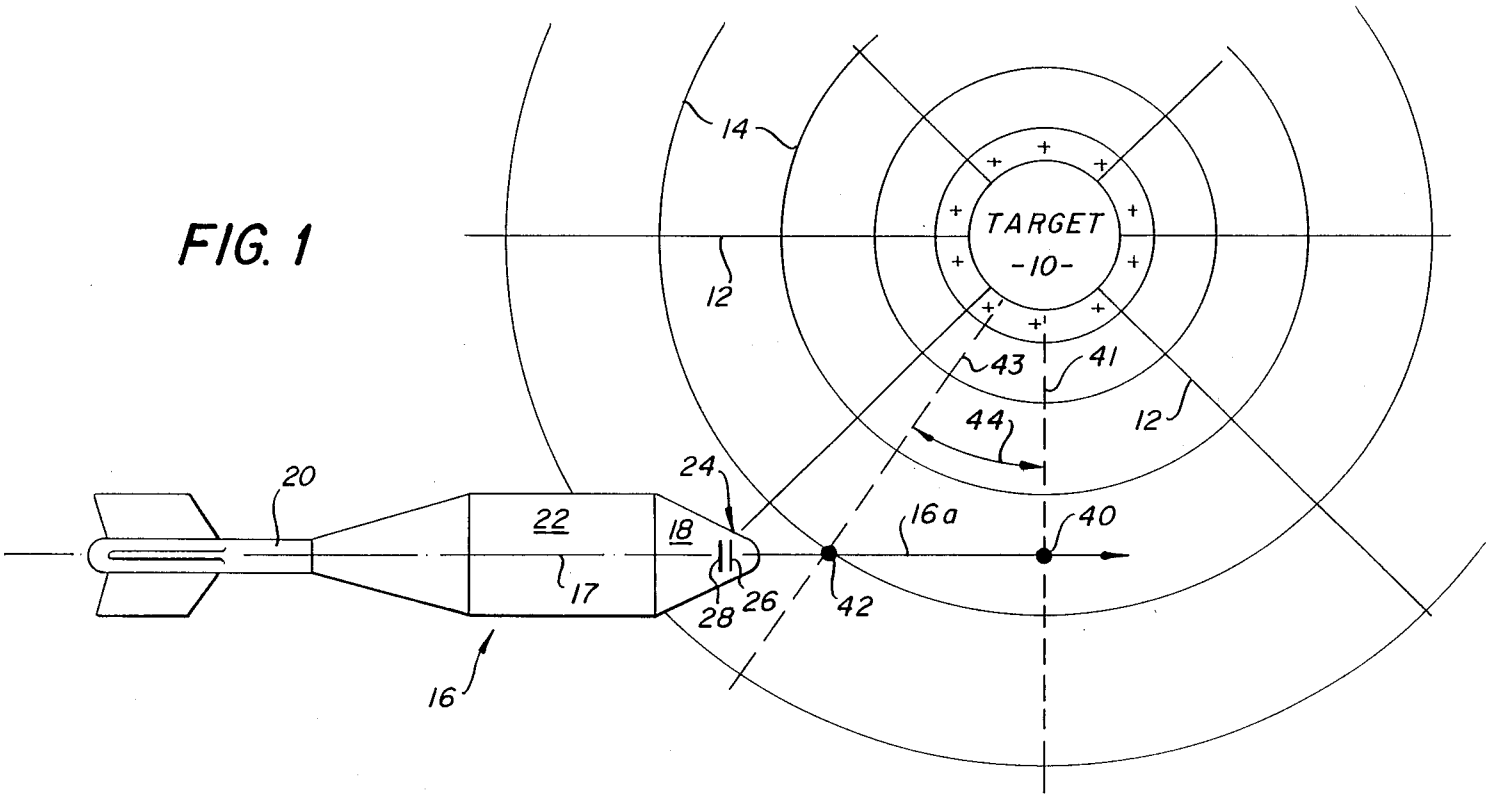
FIG. 1 is a pictorial representation of a missile entering the electric field associated with an intended airborne target and equipped with an electrostatic proximity fuzing system in accordance with the present invention.

FIG. 1 portrays an airborne target 10, such as an airplane or helicopter, which in flight through the atmosphere has accumulated the indicated surface charges. These electrostatic charges create an electric field pattern represented by flux lines 12 radiating from the target and lines 14 of equal electrostatic potential encircling the target at various radial increments. It will be appreciated that the illustrated target electric field pattern is idealized since it does not reflect the disruption created by the surface charges accumulated on the surface of a missile 16 illustrated as having entered the target electric field on a target-engaging, near-miss trajectory 16*a*.

The body of missile 16 includes a nose section 18, a finned tail section 20 and intermediate warhead section 22. The nose section contains the electrical components of the proximity fuzing system of the present invention including an electrostatic probe, generally indicated at 24 and including a pair of parallel spaced, electrically conductive plates 26 and 8 oriented perpendicular to the missile longitudinal axis 17.

Figure 2:
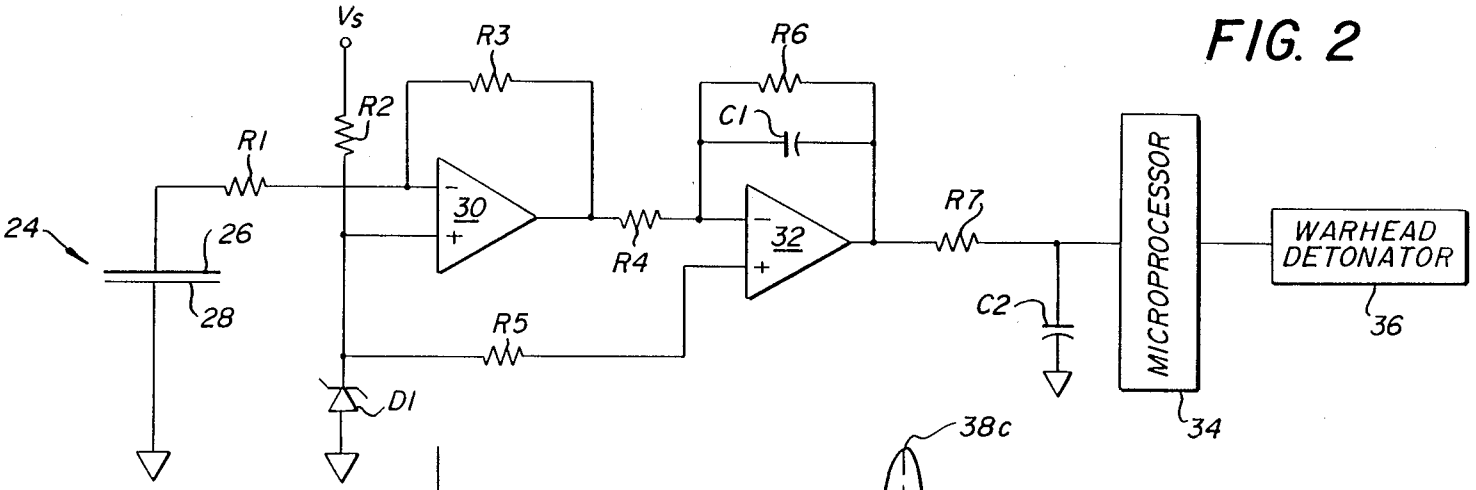
FIG. 2 is a circuit schematic, partially in block diagram form, of the electrostatic proximity fuzing system of the present invention.

As seen in FIG. 2, plate 28 is grounded, while plate 26 is connected through a resistor R1 to the inverting input of an operational amplifier 30 in a manner to establish short circuit loading of electrostatic probe 24. The non-inverting input of amplifier 30 is referenced to a regulated voltage established at the junction between a resistor R2 and a zener diode D1 connected in series between positive supply voltage $V_s$ and ground. Amplifier feedback is provided by resistor R3.

Amplifier 30 functions to convert the short circuit current signal response of electrostatic probe 24 to entry into the electric field of target 10 into a proportional signal voltage which is applied through a resistor R4 to the inverting input of a high gain operational amplifier 32. The non-inverting input of this amplifier is referenced to the regulated cathode voltage of zener diode D1 through a resistor R5. The parallel combination of resistor R6 and capacitor C1 provides high frequency roll-off for amplifier 32. The amplifier output is connected through a resistor R7 to a microprocessor 34. A filter capacitor C2 connects the microprocessor input to ground. The microprocessor converts the amplified analog probe signal received from amplifier 30 to a digital signal which is processed in accordance with a target algorithm to determine if target 10 is a valid target, and, if so, when during near-miss missile trajectory 16*a* to fire detonator 36 and explode the missile warhead so as to inflict maximum target damage.

Figure 3:
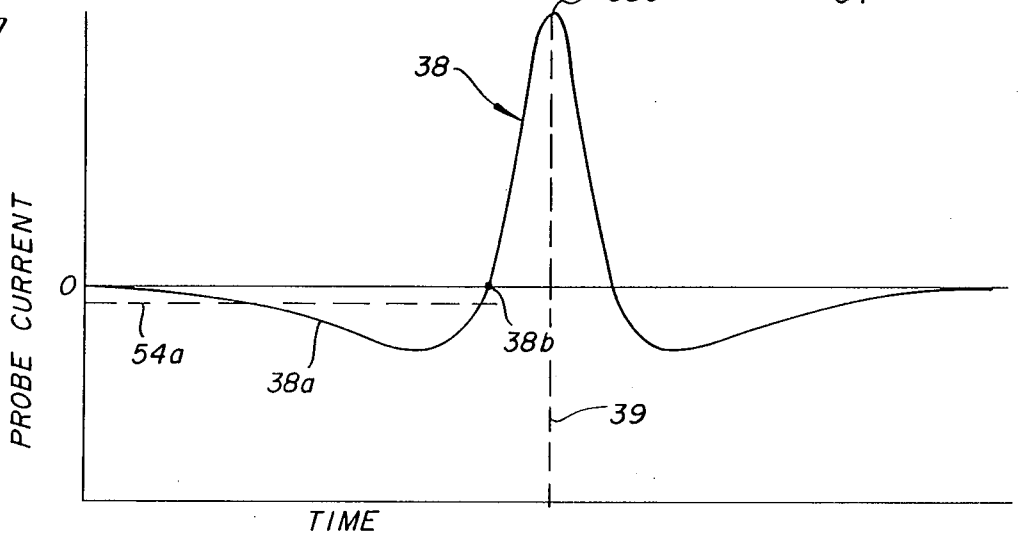
FIG. 3 is a plot of the electrostatic probe short circuit current signal response to entry into a target electric field.

By virtue of the illustrated longitudinal orientation of the electrostatic probe plates 26, 28, i.e., perpendicular to the missile longitudinal axis 17, and the short circuit loading of the probe, the probe current flowing in the input circuit of amplifier upon intercepting the electric field of an airborne target on near-miss trajectory 16*a* (FIG. 1) is of the waveform 38 seen in FIG. 3. The probe short circuit current flows with an initial increasing slope 38*a* which has been determined to vary as a function of the reciprocal of the range (R) of the probe to the target raised to the third power ($1/R^3$). While initial current flow and slope are illustrated as being negative, it will be appreciated that these signal characteristics may be positive or negative depending on the polarity of the charged target. As the target range closes, the short circuit current waveform suddenly reverses slope, crosses zero at point 38*b* and rises to a peak 38*c* of opposite polarity coincident with the point in the missile trajectory 16*a* of closest proximity to the target, indicated by dash line 39 in FIG. 2 and point 40 in FIG. 1. Beyond this point of minimum miss distance or range measured along dash line 41 (FIG. 1), the range-opening portion of the probe signal waveform is seen to be a mirror image of the range-closing waveform portion. It has been further determined that inflection point 38*b* or zero-crossing of the probe signal waveform occurs when probe 24 arrives at a position 42 where a dash line 43 intersects the missile trajectory 16*a* at an angle 44 of approximately 35° in front of dash line 41. Since zero-crossing inflection point 38*b* is a readily identifiable point on the probe signal waveform, and it occurs when probe 24 reaches position 42 in missile trajectory, these simultaneous events represent an ideal burst-point locus at which to detonate the missile warhead. By exploding the warhead before the missile reaches point 40 in its near-miss trajectory most proximate the target, missile body fragments are propelled by the combination of explosive and inertial forces more directly toward the target, thus inflicting maximum possible damage. It is seen that significantly less target damage is achieved if the warhead is detonated when probe 42 arrives at trajectory position 40 of minimum miss distance The target algorithm by which microprocessor 34 processes probe signal waveform 38 to discriminate between valid and invalid targets and, if a valid target is identified, to detonate the missile warhead at F inflection point 38*b* is disclosed in the flow chart of FIG. 4. Digital data representing the probe signal waveform is sampled on a real-time basis at a rapid rate, e.g., every 0.5 ms., as indicated in step 50. After three consecutive data samplings, the next data point is predicted based on the three data points obtained from these previous samplings in step 51. This prediction is based on the probe signal waveform 38 having an initial slope 38*a* that varies as a function of the reciprocal of the range cubed ($1/R^3$). In step 52, the target algorithm determines whether the sampled data point, considered with the previous three data points as a data point set, is within a predetermined tolerance of the predicted data point and thus can be considered a valid data point. If not, steps 51 and 52 are repeated for the next sampled data point. As long as the condition of step 52 is satisfied on a running four consecutive data point basis, the number of valid data points in successive data point sets is counted in step 53. If an invalid data point is encountered, the steps are repeated until the number of consecutive valid data points reaches a predetermined minimum number, for example thirty, established in step 53. Once this condition is satisfied, the magnitude of the net sampled data point is inspected to determine if it has reached a valid target threshold established in step 54. This threshold is indicated at 54*a* in FIG. 3. If not, steps 50–53 are repeated for a new set of sampled data points. When the conditions of steps 52 and 53 are again satisfied, and the most recent data point magnitude reaches the valid target threshold 54*a* of step 54, step 55 is activated. Here the next data point is sampled, as indicated at 56, and is tested in step 57 to determine if its magnitude exceeds valid target threshold 54*a*. If not, the target algorithm starts over with new sets of data points. However, if this next data point exceeds the valid target threshold, the subroutine including steps 55–57 is repeated to see if a predetermined minimum number of consecutive data points are in excess of the valid target threshold magnitude. When this minimum number, for example five, is reached in step 55, the decision is made that a valid target is being engaged. At this point, the target algorithm repetitively samples next data points (step 58) looking for zero-crossing inflection point 38*b* (step 59) and, when detected, warhead detonator 36 is trigqered, as indicated in step 60.

Figure 4:
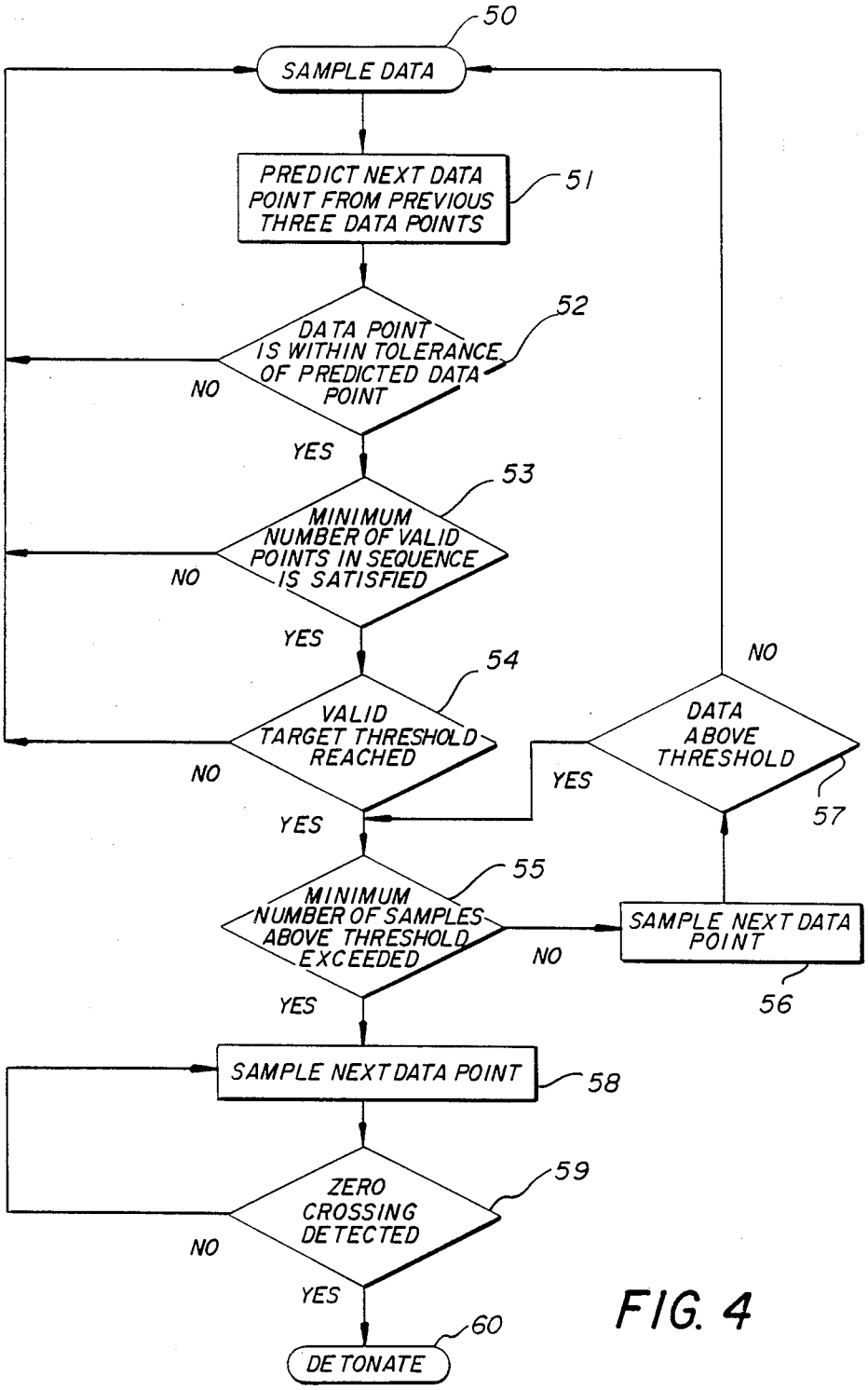
FIG. 4 is a flow chart of the target algorithm for processing the probe signal waveform of FIG. 3.

It will be appreciated that the target algorithm of FIG. 4 could be truncated to accommodate exceptionally high target closure velocities. For example, a valid target recognition decision could be made based on satisfaction of the step 53 condition, and the target algorithm would go directly to step 58, skipping steps 54–57. Alternatively, steps 51–53 could be modified such as to simply look for a constantly increasing slop between a predetermined number of consecutive data points.

It is seen that the target algorithm of FIG. 4 is uniquely constructed to reliably identify from the probe short circuit current signal waveform that missile 16 is engaging a valid airborne target 10 and thereafter to detonate the missile warhead at the most opportune moment in a near-miss trajectory to maximize target kill potential. Since the target algorithm only processes data points on the signal waveform below the signal peaks, any clipping of the analog signal peaks does not affect valid target recognition and warhead detonation. Moreover, target recognition is independent of analog signal gain, and thus amplifier gain may be set as high as ambient noise conditions permit.

If missile 16 is on an impact trajectory with target 10, the zero-crossing inflection point 38*b* does not occur, and the missile warhead explodes upon target impact.

From the foregoing description it is seen that the objects set forth above, including those made apparent hereinabove, are efficiently attained, and, since certain changes may be made in the embodiment set forth without departing from the scope of the invention, it is intended that all matters of detail be taken as illustrative and not in a limiting sense.

Having described the invention, what is claimed as new and desired to secure by Letters Patent is:

1. A proximity fuzing system for the warhead of a missile engaging an airborne target, said system comprising, in combination:

A. an electrostatic probe carried by the missile, said probe including a pair of parallel spaced, electrically conductive plates oriented perpendicular to the longitudinal axis of the missile, said probe having a voltage developed thereon upon entry into the electric field inherently surrounding an airborne target;

B. amplifier means having an input circuit connected with said plates to conduct a current signal produced by said probe voltage and having a waveform characterized by an initial slope of constantly increasing current flow in one direction as said probe approaches a valid target, a reversal in slope and a crossing of current zero when said probe reaches a proximate position relative to the target on a near-miss missile trajectory, and a rapid rise to peak current flow in an opposite direction when said probe reaches a position of minimum miss-distance relative to the target;

C. a detonator for the missile warhead; and

D. a microprocessor for processing said current signal in accordance with a target algorithm such as to recognize a valid target from the characteristics of said initial slope portion of said current signal waveform and to trigger said detonator to explode the missile warhead when said current signal crosses zero.

2. The proximity fuzing system defined in claim 1, wherein said microprocessor includes first means for periodically sampling said current signal to produce a succession of data points indicative of the real-time current magnitude thereof and second means for examining successive sets of said data points to determine the slope characteristics of said initial slope portion of said current signal.

3. The proximity fuzing system defined in claim 2, wherein said second microprocessor means determines from successive said data point sets if said slope portion of said current signal increases as an approximate function of the reciprocal of the range of said probe to the target raised to the third power pursuant to a first condition for qualifying the target as a valid target.

4. The proximity fuzing system defined in claim 3, wherein said microprocessor further includes third means for accumulating a first count of the number of times successive said data point sets satisfy said first condition and, as a second condition, further qualifies the target as a valid target when said first count reaches an established minimum number.

5. The proximity fuzing system defined in claim 4, wherein said microprocessor further includes fourth means responsive to the satisfaction of said second condition for determining if the next sampled said data point has reached an established threshold magnitude as a third condition for qualifying a target as a valid target.

6. The proximity fuzing system defined in claim 5, wherein said microprocessor further includes fifth means responsive to the satisfaction of said third condition for accumulating a second count of the number of times next sampled said data points exceed said threshold magnitude and to finally qualify the target as a valid target when said second count reaches a predetermined minimum number.

7. The proximity fuzing system defined in claim 6, wherein said microprocessor further includes sixth means responsive to the final valid target qualification by said fifth means for continuously examining next sampled said data points to detect said zero current crossing of said current signal and thereupon to trigger said detonator.

8. The proximity fuzing system defined in claim 7, wherein said zero current crossing occurs when said probe reaches said proximate position along the near-miss trajectory of the missile that is angularly displaced from said minimum miss-distance probe position by approximately 35 degrees.

* * * * *